US007695247B1

(12) United States Patent
Liang

(10) Patent No.: US 7,695,247 B1
(45) Date of Patent: Apr. 13, 2010

(54) TURBINE BLADE PLATFORM WITH NEAR-WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 523 days.

(21) Appl. No.: 11/514,815

(22) Filed: Sep. 1, 2006

(51) Int. Cl.
*F01D 5/18* (2006.01)
*F01D 5/18* (2006.01)

(52) U.S. Cl. ..... 416/97 R; 416/193 A

(58) Field of Classification Search ..... 415/115–116, 415/1; 416/95, 96 R, 96 A, 97 R, 97 A, 193 A, 416/1

See application file for complete search history.

(56) References Cited

U.S. PATENT DOCUMENTS

| | | | | |
|---|---|---|---|---|
| 4,017,213 | A | 4/1977 | Przirembel | |
| 4,353,679 | A | 10/1982 | Hauser | |
| 5,344,283 | A | 9/1994 | Magowan et al. | |
| 5,382,135 | A | 1/1995 | Green | |
| 5,413,458 | A | 5/1995 | Calderbank | |
| 5,639,216 | A | 6/1997 | McLaurin et al. | |
| 6,017,189 | A | 1/2000 | Judet et al. | |
| 6,019,579 | A | 2/2000 | Fukuno et al. | |
| 6,071,075 | A | 6/2000 | Tomita et al. | |
| 6,120,249 | A | 9/2000 | Hultgren et al. | |
| 6,190,130 | B1 | 2/2001 | Fukue et al. | |
| 6,196,799 | B1 | 3/2001 | Fukue et al. | |
| 6,241,467 | B1 * | 6/2001 | Zelesky et al. | 415/115 |
| 6,254,333 | B1 | 7/2001 | Merry | |
| 6,416,284 | B1 | 7/2002 | Demers et al. | |
| 6,478,540 | B2 | 11/2002 | Abuaf et al. | |
| 6,945,749 | B2 | 9/2005 | De Cardenas | |
| 2006/0269409 | A1 * | 11/2006 | Torii et al. | 416/97 R |
| 2007/0020100 | A1 * | 1/2007 | Beeck et al. | 416/193 A |

* cited by examiner

*Primary Examiner*—Christopher Verdier
(74) *Attorney, Agent, or Firm*—John Ryznic

(57) ABSTRACT

A turbine blade having a platform and an airfoil extending from the platform. The platform includes a plurality of pressure side cooling channels formed within the platform and extending from a location along the aft edge of the platform. Each cooling channel includes a supply hole connected to the box rim cavity formed below the platform. Each pressure side cooling channel opens into a diffuser positioned along the pressure side edge of the platform to discharge cooling air onto the suction side platform of an adjacent blade. The suction side of the platform has cooling channels with supply holes connected to the box rim cavity and discharge holes positioned along the aft edge of the platform. The pressure side and suction side cooling channels in the platform have a curvature substantially of the same curvature as the airfoil in order to cool the entire platform surface exposed to the hot gas flow.

20 Claims, 3 Drawing Sheets

TURBINE BLADE PLATFORM WITH NEAR-WALL COOLING

BACKGROUND OF THE INVENTION

1. Field of the Invention

The present invention relates generally to rotary kinetic fluid motors and pumps, and more specifically to turbine blade platforms and cooling thereof.

2. Description of the Related Art Including Information Disclosed Under 37 CFR 1.97 and 1.98

A gas turbine engine produces a hot gas flow of extremely high temperature that passes through a turbine for converting the flow into mechanical power to drive the rotor shaft on which the turbine is connected. One method of increasing the efficiency of the engine is to increase the temperature of the hot gas flow into the turbine. However, the temperature is limited to the material properties of the parts within the turbine, specifically the first stage stationary vanes and rotor blades because these parts are exposed to the hottest gas temperatures.

One method used to allow for higher temperatures while using the same materials is to provide for cooling air to pass through the vanes and blades in order to prevent the parts from thermal damage. Since the cooling air must also be under high pressure in order to prevent backflow of the hot gas flow into the airfoils, the cooling air is generally bled off from the compressor at the appropriate stage. Thus, the engine efficiency is decreased because the work performed by the compressor on the bleed off air used for cooling is wasted. Therefore, another method for increasing the efficiency of the engine is to minimize the amount of cooling air used in the airfoils while maximizing the amount of cooling this air can provide. Elaborate and complex cooling passage designs has been proposed in order to attain this goal.

Turbine blades in a gas turbine engine generally include a root, an airfoil extending from the root, and a platform extending from the root to airfoil transition. The platform forms a flow path surface for the hot gas flow to prevent the flow from passing around the rotor shaft section. FIG. 1 shows a Prior Art technique used to cool the platform of a turbine blade. The blade 12 includes a pressure side platform 13 and a suction side platform 14, with a film cooling hole 16 in the platform 13 to supply cooling air from a dead rim cavity 17 formed below the two platforms. The blade is cooled by long length to diameter cooling channels and film cooling that yields successful results. U.S. Pat. No. 5,382,135 issued to Green on Jan. 17, 1995 entitled ROTOR BLADE WITH COOLED INTEGRAL PLATFORM discloses a blade with platform cooling of this design. This design utilizing film cooling for the entire blade platform requires cooling air supply pressure at the blade dead rim cavity 17 higher than the peak blade platform external gas side pressure. This induces high leakage flow around the blade attachment region and thus causes a performance penalty, reducing the engine efficiency.

Another method of cooling the blade platform is shown in FIG. 2. This design also utilizes long length-to-diameter cooling channels that are drilled from the platform edge to the airfoil cooling core. A pressure side long length-to-diameter cooling channel 26 is located on the pressure side platform 23 and connects with the cooling channel 25 in the blade. A suction side platform 24 includes a cooling channel 24 that also connects to the cooling channel 25. The dead rim cavity 27 is formed below the two adjacent platforms 23 and 24. In this design, the blade platform wall produces unacceptable stress levels at the airfoil cooling core and platform cooling channels interface locations, and thus yield a low blade life. This is primary due to the large mass at the front and back end of the blade attachment which constrains the blade platform expansion. In conjunction with the cooling channels are oriented at transverse to the primary direction of the stress field and high stress concentration associates with the cooling channels at the entrance location.

Studies have shown that over temperature occur at the blade platform pressure side location as well as the aft portion of the suction side platform edge and the aft section of the suction side platform versus the airfoil junction. To address this over temperature problem, the blade platform cooling design of FIG. 3 was proposed. Two long length-to-diameter cooling channels 31 parallel to the blade platform are used to cool the platform pressure side surface. Supply cooling hole 32 delivers cooling air to the channel 31, and an exit hole 33 discharges the cooling air. A large diameter cooling channel 34 running along the platform suction side edge is supplied with cooling air from a supply cooling hole 35 and discharges through an exit hole 36, with three small channels 37 branching off from the large channel 34 that cool the platform suction side surface. In general, the cooling air is fed into the long length-to-diameter channels 31 and 34 at the front end of the platform with the dead rim cavity air through the supply holes 32 and 35, and then discharged at the aft face of the blade platform through the exit holes 33 and 36.

It is an object of the present invention to provide for a cooling air design for a blade platform in a gas turbine engine that will be more efficient that the cited prior art designs, and therefore improve the efficiency of the gas turbine engine.

BRIEF SUMMARY OF THE INVENTION

The present invention is a turbine blade with a platform having cooling air passages therein, the passages being a near wall super channel cooling with thin diffusion slots formed in the blade platform. The near wall super channel with thin diffusion slot is constructed at close spacing to the hot flow path with a series of curved cooling channels, parallel to the airfoil contour, and with build-in Chevron trip strips or short pin fins within the cooling channel. Cooling air is channeled from the leading edge to the pressure side of the platform edge fro the platform pressure side cooling. The cooling air is channeled from the leading edge to the of end of the blade platform for the suction side platform cooling. Thin elongated film slots are incorporated at the exit of the super channels. The cooling slot is in the formation of gradually increasing the cross sectional flow and slot width while decreasing slot height along the slot length, thus being transformed from a rectangular cross section at the inlet into a narrow elongated slot at the exit plane.

The cooling air is fed into the pressure side super cooling channels at the front end of the blade platform with the dead rim cavity air which provide convective cooling for the platform pressure surface first, and then is discharged onto the platform pressure side aft edge or mate face locations. Thin diffusion slot is incorporated at the end of the pressure side cooling channel to spread the spent cooling air. An exit flow area for the thin diffusion slot to cooling channel flow area ration can be sized as high as five-to-one. In addition, the thin slot can be designed at width-to-height ration in the range of six-to-twelve. This spreads the spent cooling air effectively to provide a uniform film layer to cool the airfoil suction side edge as well as down stream of the platform suction side surface.

As a result of the present invention cooling design, the airfoil platform surface is cooled by the combination of both film and convective cooling methods. The double use of cooling air improves the over-all platform cooling efficiency and reduces the platform metal temperature or cooling consumption. Thus, a higher hot gas flow temperature can be used in the turbine.

DETAILED DESCRIPTION OF THE INVENTION

Figure 1:
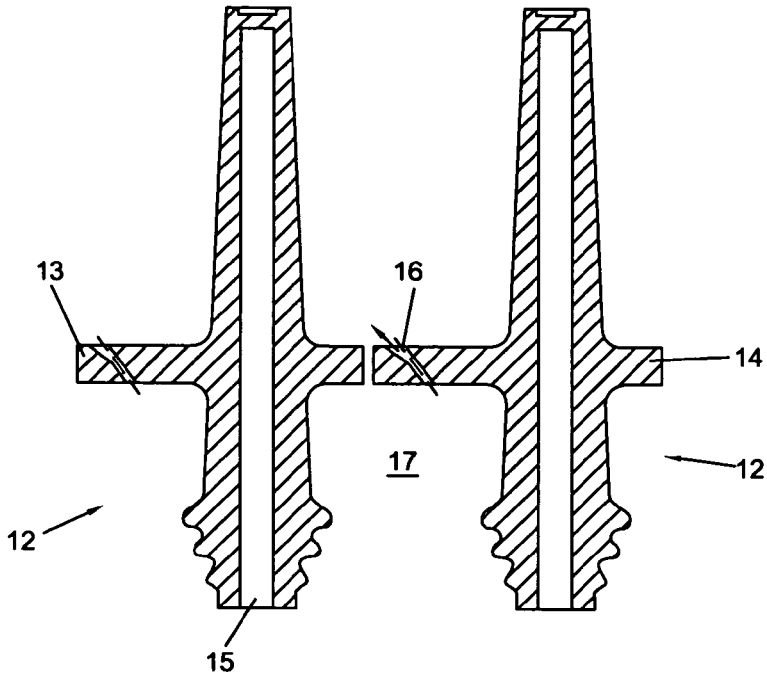
Fig 1 Prior Art
FIG. 1 shows a cross section of a prior art turbine blade platform cooling design.
Figure 2:
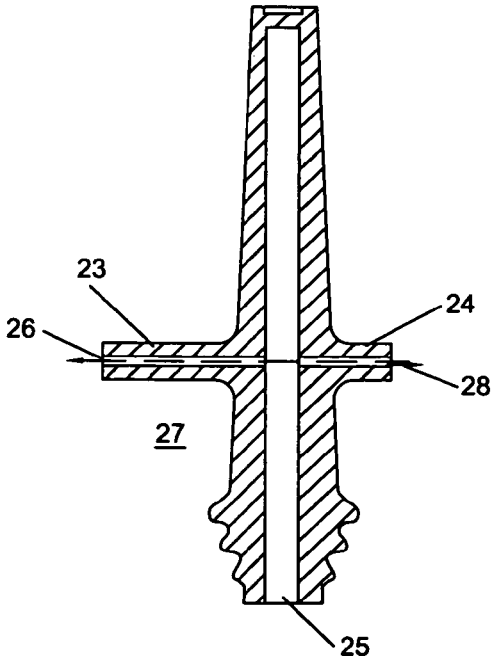
Fig 2 Prior Art
FIG. 2 shows a cross section of a second prior art turbine blade platform cooling design.
Figure 3:
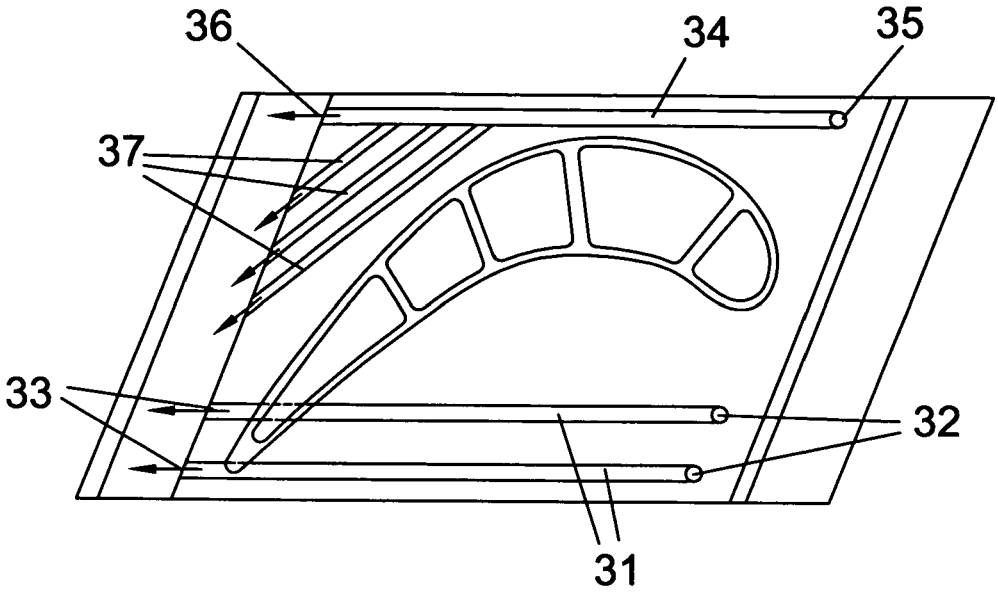
Fig 3 Prior Art
FIG. 3 shows a top view of a third prior art turbine blade platform cooling design.
Figure 4:
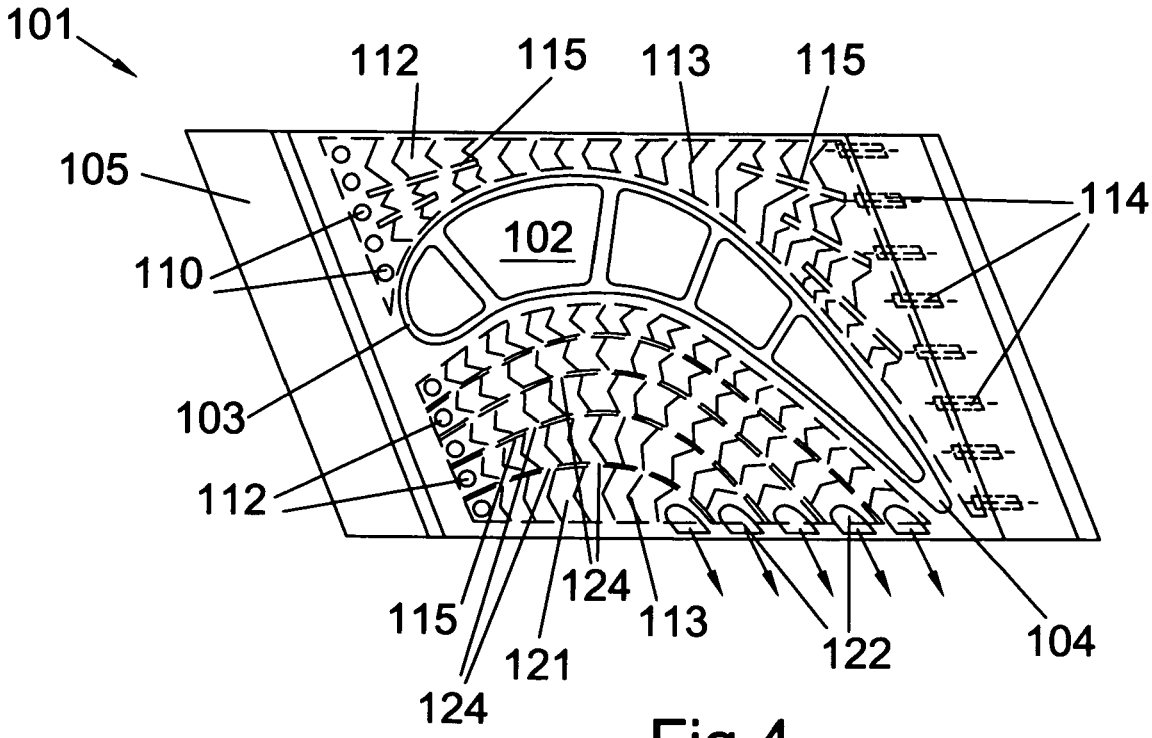
FIG. 4 shows a top view of the present invention blade platform cooling design.

The present invention is a turbine blade platform cooling passage arrangement to provide both film cooling and convective cooling to the platform of both the pressure side and suction side. The blade forms a series of internal cooling channels 102 formed between a blade leading edge 103 and a trailing edge 104. The blade includes a platform 105 with a plurality of rows of the super cooling channels that form part of the present invention. The suction side of the blade includes a plurality of super cooling channels 112 extending from the leading edge side of the platform to the trailing edge side. Cooling supply holes 110 deliver cooling air from the dead rim cavity formed below the platform into the suction side super cooling channels 112. The inlet openings of the pressure side channels are cooling impingement holes and extend along a line substantially parallel to the forward edge of the platform. On the suction side, three super channels 112 converge into one super channel at about the platform midpoint, and then diverge into four super channels that connect to exit cooling holes 114 for cooling air exit to the aft rim. The plurality of suction side curved cooling channels 112 covers substantially the entire suction side platform surface. The exit cooling holes 114 discharge into the aft rim cavity according to the prior art designs. Walls 115 are formed to separate the super channels. Opening 124 along the walls 115 function as core ties between adjacent super channels 121 which are holes in the ceramic core to tie up both channels. Chevron trip strips 113 are positioned along the super channels 112 in order to induce turbulence in the flow. Short pin fins could also be used. The cooling supply holes 110 are arranged along a line near the forward edge of the platform as shown in FIG. 4. The cooling exit holes 114 are arranged along a side of the aft edge of the platform as shown in FIG. 4.

Figure 5:
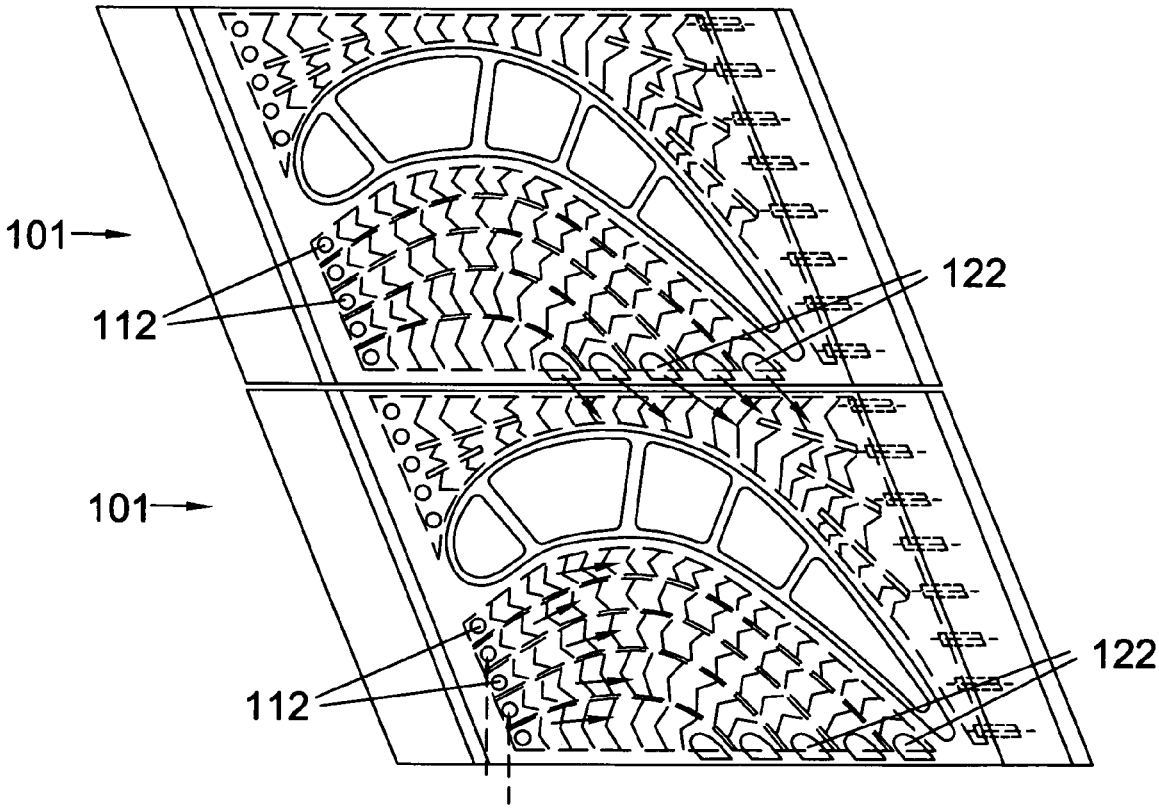
FIG. 5 shows a top view of the present invention with two platforms adjacent one another.

The pressure side includes five super cooling channels 121 that start on the leading edge of the platform and bend around the pressure side platform and end near the pressure side edge of the platform. Cooling supply holes 112 are located at the upstream end of the super cooling channel 121, and thin elongated diffusion slots 122 are located at the exit end of the super channel 121. The diffusion slots 122 open onto the top surface of the platform and discharge cooling air onto the suction side platform surface of the adjacent blade and platform as shown in FIG. 5. The super channels 121 on the pressure side are constructed of close spacing to the hot flow path and generally follow the contour of the pressure side airfoil. Some of the pressure side cooling channels 121 have a wider middle section so that substantially the entire pressure side platform is covered by the pressure side cooling channels. A plurality of Chevron trip strips 113 are also spaced along the super channels 121. Walls 115 with core tie are also formed in the platform to separate the super channels 121. On the pressure side, the super channels do not merge and converge as those on the suction side.

Cooling air fed into the pressure side super cooling channels 121 through supply holes 110 at the front end of the blade platform from the dead rim cavity provide convective cooling for the platform pressure surface first, and then the cooling air is discharged through the diffusion slots 122 and onto the platform pressure side aft edge or mate face locations. The thin diffusion slot 122 is incorporated at the end of the pressure side super cooling channel 121 to spread the spent cooling air. The diffusion slots are positioned on the platform to discharge film cooling air onto an adjacent turbine rotor blade platform on an aft half of the suction side surface of the platform. An exit flow area for the thin diffusion slot 122 to slot inlet metering area can be sized as high as 5-to-1 and with a width to height ratio in the range of 6-to-12. This spreads the spent cooling air effectively to provide a uniform film layer to cool the airfoil suction side edge as well as down stream of the platform suction surface as shown in FIG. 5. The cooling air discharged from the diffusers cools the aft half of the suction side platform as shown in FIG. 5.

The super cooling channels and Chevron trip strips and walls can all be formed into the airfoil during the airfoil casting and the well-known bleaching process. The platform is shown with five super cooling channels on the pressure side. However, more or less channels can be used without departing from the field and scope of the invention. Chevron trip strips are shown to promote turbulent flow within the channels. However, other turbulent producing forms such as the short pin fins described above or other forms can also be used. Eight of the exit cooling holes 114 for the suction side channels are shown. However, more or less than eight of these exit holes can be used.

I claim the following:

1. A turbine rotor blade comprising:

a platform having an outer surface forming a hot gas flow path and an inner surface separating the hot gas flow path from a box rim cavity;

an airfoil extending from the platform;

the airfoil having a pressure side wall and a suction side wall;

the platform having a pressure side edge and a suction side edge, and a forward edge and an aft edge;

a plurality of curved cooling channels on the pressure side of the platform covering the pressure side platform from the pressure side edge to the pressure side wall of the airfoil; and, some of the pressure side cooling channels having a wider middle section than other of the pressure side curved cooling channels so that substantially the entire pressure side platform is covered by the pressure side cooling channels.

2. The turbine rotor blade of claim 1, and further comprising:

the pressure side cooling channels each include trip strips extending along each channel from an inlet to an outlet of the channel.

3. The turbine rotor blade of claim 1, and further comprising:

the pressure side cooling channels each have an outlet opening into a diffusion slot that opens onto the outer surface and on the suction side edge of the platform.

4. The turbine rotor blade of claim 3, and further comprising:

the pressure side channels each have an inlet opening into the box rim cavity below the platform.

5. The turbine rotor blade of claim 1, and further comprising:

the pressure side channels are separated by walls with openings along the walls that fluidly connect adjacent cooling channels.

6. The turbine rotor blade of claim 1, and further comprising:

a plurality of curved cooling channels on the suction side of the platform; and, the plurality of suction side curved cooling channels covering substantially the entire suction side platform surface.

7. The turbine rotor blade of claim 6, and further comprising:

the suction side channels are formed by walls along an upstream end of the channels and walls along the downstream end of the channels, and with the channels converging into a single channel between the upstream end and the downstream end.

8. The turbine rotor blade of claim 6, and further comprising:

the suction side channels include a plurality of exit cooling holes that open onto a side of the aft edge of the platform.

9. The turbine rotor blade of claim 6, and further comprising:

the suction side cooling channels include a plurality of inlet cooling holes connected to the bottom of the platform.

10. The turbine rotor blade of claim 3, and further comprising:

the diffusion slots are positioned on the platform to discharge film cooling air onto an adjacent turbine rotor blade platform on an aft half of the suction side surface of the platform.

11. The turbine rotor blade of claim 4, and further comprising:

the inlet openings of the pressure side channels are cooling supply and impingement holes and extend along a line substantially parallel to the forward edge of the platform.

12. A turbine rotor blade comprising:

a platform having an outer surface forming a hot gas flow path and an inner surface separating the hot gas flow path from a box rim cavity;

an airfoil extending from the platform;

the airfoil having a pressure side wall and a suction side wall;

the platform having a pressure side edge and a suction side edge, and a forward edge and an aft edge;

a plurality of curved cooling channels on the pressure side of the platform;

the plurality of pressure side curved cooling channels being separated by walls extending a length of the channel; and, a plurality of openings in each wall to fluidly connect adjacent cooling channels.

13. The turbine rotor blade of claim 12, and further comprising:

one of the pressure side curved cooling channels having a wider middle section than another of the pressure side curved cooling channels so that substantially the entire pressure side platform is covered by the pressure side cooling channels.

14. The turbine rotor blade of claim 12, and further comprising:

the pressure side cooling channels each include trip strips extending along each channel from an inlet to an outlet of the channel.

15. The turbine rotor blade of claim 12, and further comprising:

the plurality of pressure side curved cooling channels each include an inlet hole connected to the box rim cavity and an outlet opening into a diffusion slot;

the pressure side cooling channels covering substantially the entire surface of the pressure side platform; and, the diffusion slots open onto the outer surface of the platform along the pressure side edge of the platform.

16. A turbine rotor blade comprising:

a platform having an outer surface forming a hot gas flow path and an inner surface separating the hot gas flow path from a box rim cavity;

an airfoil extending from the platform;

the airfoil having a pressure side wall and a suction side wall;

the platform having a pressure side edge and a suction side edge, and a forward edge and an aft edge;

a plurality of curved cooling channels in the pressure side of the platform;

each pressure side curved cooling channel having an inlet near to the forward edge of the platform and an outlet opening onto the platform at the pressure side edge;

a plurality of curved suction side cooling channels in the suction side of the platform;

each suction side curved cooling channel having an inlet near to the forward edge of the platform and an outlet opening on a side of the aft edge of the platform; and, the curved cooling channels covering substantially the entire platform surface.

17. The turbine rotor blade of claim 16, and further comprising:

the pressure side curved cooling channels being separated by walls that have openings to fluidly connect adjacent curved cooling channels.

18. The turbine rotor blade of claim 16, and further comprising:

the suction side curved cooling channels are formed by walls along an upstream end of the channels and walls along the downstream end of the channels, and with the channels merging into a single channel in the middle section.

19. The turbine rotor blade of claim 18, and further comprising:

the upstream walls and the downstream walls of the suction side curved cooling channels each include an opening to fluidly connect adjacent channels.

20. The turbine rotor blade of claim 19, and further comprising:

supplying cooling air to the platform along the entire forward edge of the platform.

* * * * *